United States Patent [19]

Labate

[11] 4,396,179

[45] Aug. 2, 1983

[54] DEVICE FOR INTRODUCING GAS INTO MOLTEN METAL

[76] Inventor: Micheal D. Labate, 115 Hazen Ave., Ellwood City, Pa. 16117

[21] Appl. No.: 382,966

[22] Filed: May 28, 1982

[51] Int. Cl.[3] ..... C21C 5/48

[52] U.S. Cl. ..... 266/220; 266/217; 75/59

[58] Field of Search ..... 266/220, 266, 270, 265, 266/268, 217; 75/59

[56] References Cited

U.S. PATENT DOCUMENTS 3,208,117 9/1965 Goedecke et al. ..... 75/59
4,053,147 10/1977 Moser et al. ..... 266/220

FOREIGN PATENT DOCUMENTS 2451945 11/1980 France ..... 266/265
2041182 9/1980 United Kingdom ..... 75/59

*Primary Examiner*—L. Dewayne Rutledge
*Assistant Examiner*—Scott Kastler
*Attorney, Agent, or Firm*—Harpman & Harpman

[57] ABSTRACT

A solid non-permeable refractory plug has a spaced stainless steel jacket and is located in a pocket block for incorporation in the normal refractory brick lining of a ladle to provide a structure through which gas can be introduced into the molten metal, primary and secondary covers protect the device from metal and/or slag penetration during the filling of the ladle with molten metal.

8 Claims, 3 Drawing Figures

DEVICE FOR INTRODUCING GAS INTO MOLTEN METAL

BACKGROUND OF THE INVENTION (1) Technical Field

This invention relates to devices for insufflating gas into a mass of molten metal.

(2) Description of the Prior Art

Prior structures of this type have generally employed permeable plugs through which the gas is introduced into the liquid. Such typical devices may be seen in U.S. Pat. Nos. 2,811,346, 2,947,527, 3,330,645, 3,610,602 and 3,343,829.

U.S. Pat. No. 3,343,829 discloses a plug having an outer non-permeable shell and an inner gas permeable portion. The present invention avoids the problems that have been commonly associated with the prior art devices and particularly the blocking and delaying of the introduction of the gas flow by the first contact of the device with molten metal or slag poured into the ladle.

SUMMARY OF THE INVENTION

A device for introducing gas into molten metal immediately upon filling of a ladle or the like with such molten metal incorporates a pocket block of refractory which is easily incorporated into the brick or rammed lining of the ladle, the block having a conical passageway therethrough and a plug positioned therein comprising a non-permeable refractory plug with a spaced stainless steel or ceramic shell thereabout to define a gas passageway through the block. Primary and secondary covers are used to protect the plug and shell during the introduction of molten metal into the ladle whereby gas for agitating, stirring, rolling and/or affecting the desired chemistry can be immediately introduced into the molten metal.

DESCRIPTION OF THE PREFERRED EMBODIMENT

Figure 1:
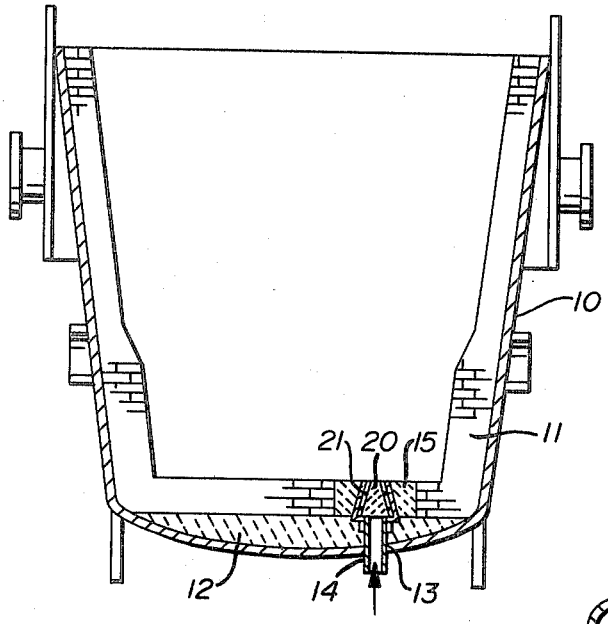
FIG. 1 is a cross sectional side elevation of a ladle showing the device for introducing gas into molten metal installed therein.
Figure 2:
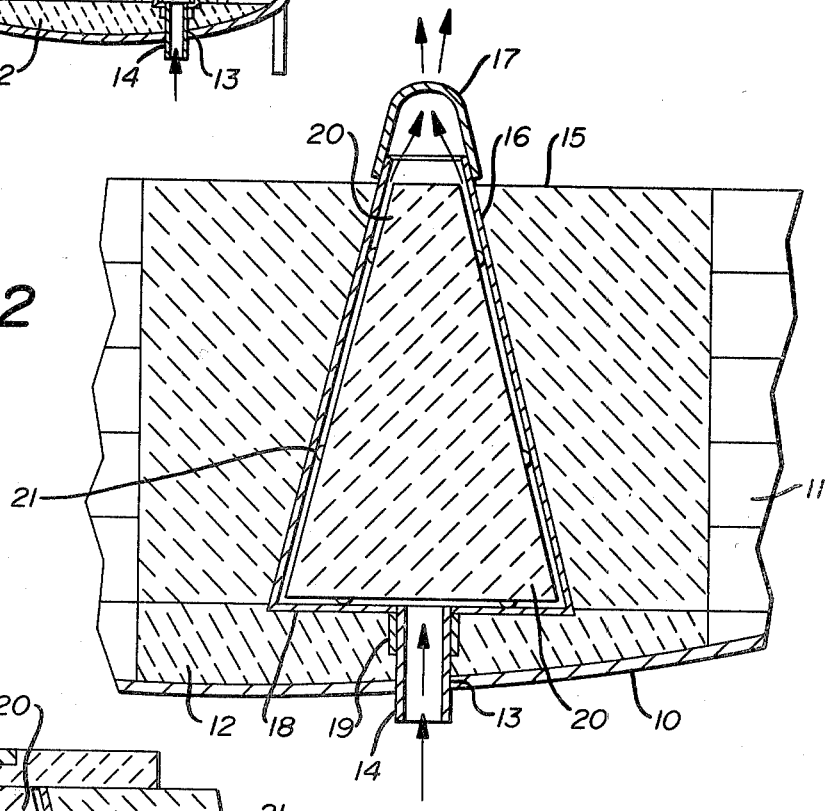
FIG. 2 is an enlarged cross sectional detail of the device for introducing gas into molten metal and illustrating a primary cover incorporated therewith.
Figure 3:
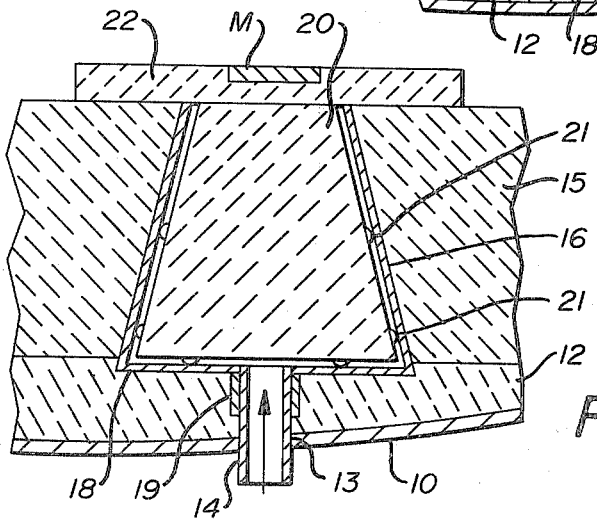
FIG. 3 is a similar cross sectional elevation illustrating the device after repeated use and incorporating a secondary cover in protective position thereon.

In the form of the invention chosen for illustration herein, the device for introducing gas into molten metal may be seen in FIGS. 1, 2 and 3 of the drawings in a ladle 10 having a refractory brick lining 11 incorporating a rammed refractory base 12. An opening 13 in the bottom of the ladle 10 is provided with a tube 14 through which gas is introduced. A pocket block 15 is provided with a conical passageway centrally thereof which is arranged in registry with the inner upper end of the tube 14, a frustroconical shell 16 preferably made of stainless steel or a fired ceramic, as best seen in FIG. 2 of the drawings, has an open upper end which is initially protected by a primary cover 17 which is made of metal or fired ceramic of desired density and is impervious. The bottom of the frustro-conical shell 16 is a circular disc 18 and an annular flange 19 centrally thereof defines an opening therethrough, the annular flange 19 being adapted for registry over the tube 14 through which the gas is introduced into the ladle.

The majority of the interior of the frustroconical shell 16 is filled by a solid ceramic plug 20 and configurations 21 on the exterior of the plug 20 or alternately on the interior of the shell 16 provide for the spacing of the shell 16 with respect to the plug 20 so that a gas passageway annular in cross section is formed through the pocket block 15 and thus provides that gas introduced into the tube 14 will flow around the exterior of the solid plug 20 and into the primary cap 17 (see arrows) which will be lifted thereby from its closure position shown by gas pressure which action is facilitated by its softening and/or melting from its contact with the molten metal while it is protecting the shell 16 and plug 20 so as to maintain the desired passageway therethrough.

In FIG. 1 of the drawings, the device is shown in operable arrangement and it will be observed that the gas will flow through the device to cause the molten metal to become agitated, stirred or rolled as the gas defuses up through the molten metal and carries out the desired metallurgical effect.

By referring now to FIG. 3 of the drawings, it will be seen that the ladle equipped with the device for introducing gas thereinto as disclosed herein has been subjected to a number of successive fillings and emptying of molten metal, either ferrous or non ferrous, and that the wearing away of the refractory lining 11 has occurred including wearing away a portion of the refractory pocket block 15 and the upper portion of the frustro-conical shell 16 as well as the upper portion of the solid ceramic plug 20. A secondary cover taking the form of a metal or ceramic disc 22 of a desired density which is impervious is shown in the pocket block 15 in covering relation to the upper annular end of the shell 16 and the upper end of the solid plug 20 where it will protect the same during the initial stages of filling the ladle with molten metal. The disc 22 is readily positioned on the pocket block 15 through the use of a positioning arm not shown which may have either a suction cup, a mechanical fastening device or it may carry a magnet for engaging and holding the disc 22 when the same is formed of ferrous metal. Alternately, a magnet M may be embedded in the disc 22 when the same is ceramic and in either event the disc 22 is positioned as shown in FIG. 3 where it forms the secondary cover. The positioning arm is removed by tilting the same and the suction cup or magnetic device on the free end thereof relative to the secondary cover 22 so as to free the temporary connection, as will occur to those skilled in the art.

It will thus be seen that the solid ceramic plug 20 and the metal or ceramic shell 16 arranged in spaced relation therearound provides a passageway for gas to be introduced into molten metal in the ladle at the time of its initial installation by way of the primary cover 17 and thereafter by the secondary covers 22 which are installed quickly and easily before the ladle is again refilled. The solid ceramic plug 20 cannot be filled with metal as occurs in the prior art devices wherein the plugs were formed of porous refractory material and the device insures the desirable immediate introduction of gas into the molten metal which is often seriously delayed by the blocking of the prior art devices with the molten metal engaging the unprotected defusing plugs and the like.

The primary cover 17 and the secondary cover 22, a number of which are used during the life of the ladle between relinings are formed so as to protect the shell 16, whether metal or ceramic, and the solid ceramic plug 20 of the device during the filling of the ladle and those skilled in the art will observe that the protection of the shell 16 and the plug 20 extend the life of the same many times since it is the first contact with the molten metal or slag that causes the heretofore troublesome plugging, reduction of the amount of gas that can be introduced into the molten metal and thus undesirably extending the time required to stir or otherwise advantageously move or displace the molten metal. It will also be observed that a number of the devices disclosed herein may be incorporated in a hot metal ladle or similar container such as a torpedo car and depending upon the amount of gas to be introduced thereinto and the areas thereof into which the gas is introduced.

Although but one embodiment of the present invention has been illustrated and described, it will be apparent to those skilled in the art that various changes and modifications may be made therein without deparating from the spirit of the invention and having thus described my invention,

What I claim is:

1. In a device for introducing gas into a mass of molten metal, the improvement which comprises a solid plug having a frustro-conical body of refractory material and a frustroconical shell positioned thereabout in spaced relation thereof, a pocket block having a frustroconical passageway extending therethrough, said block adapted to form a portion of a refractory lining in a container for said molten metal, said container having an opening therein in registry with said frustroconical passageway in said pocket block, said solid frustroconical body and frustroconical shell positioned in said frustroconical passageway, a plurality of impervious covers for said solid body and shell, each of said covers being arranged to be replaceably positioned in covering relation to said body and shell and facing the interior of said containers before each filling of said container with molten metal.

2. The improvement in a device for introducing gas into a mass of molten metal set forth in claim 1 and in which a plurality of projections are formed on the outer surface of said solid plug arranged to position said conical shell in spaced relation thereto.

3. The improvement in a device for introducing gas into a mass of molten metal set forth in claim 1 and wherein a plurality of projections are formed on the inner surface of said frustroconical shell and arranged to space said shell with respect to said frustroconical body.

4. The improvement in a device for introducing gas into a mass of molten metal set forth in claim 1 and wherein said frustroconical shell is of an exterior size matching the interior size of said frustroconical passageway in said pocket block.

5. The improvement in a device for introducing gas into a mass of molten metal set forth in claim 1 wherein at least one of said plurality of covers is formed in an inverted cup-shape for registry over said frustroconical passageway and frustroconical shell therein.

6. The improvement in a device for introducing gas into a mass of molten metal set forth in claim 1 and wherein at least several of said covers are flat members of a size greater than any diameter of said frustroconical body and frustroconical shell so as to cover the same when positioned on said pocket block during the life thereof and before each filling of said container with molten metal.

7. The improvement in a device for introducing gas into a mass of molten metal set forth in claim 1 and wherein said plurality of covers are formed of refractory material of a lower density than the refractory material of said frustroconical body so as to have less resistance to erosion than said frustroconical body.

8. The improvement in a device for introducing gas into a mass of molten metal set forth in claim 1 and wherein at least several of said covers are flat members of a size greater than any diameter of said frustroconical body and said frustroconical shell so as to cover the same when positioned on said pocket block during the life thereof and before each filling of said container with molten metal and wherein a magnetic fastening device is positioned in each of said several covers so that each of said several covers may be placed in position on said pocket block by a secondary magnetic device and a positioning arm extending therefrom.

* * * * *